US005561879A

United States Patent [19]

Everall

[11] Patent Number: 5,561,879

[45] Date of Patent: Oct. 8, 1996

[54] SUPPORTIVE MATTRESS

[76] Inventor: David Everall, 10 Sunnyside Gardens, Sandwich, Kent, England, CT13 0QH

[21] Appl. No.: 372,384

[22] Filed: Jan. 13, 1995

[51] Int. Cl.[6] ..... A47C 27/14; A47G 9/00; A47D 13/00

[52] U.S. Cl. ..... 5/655; 5/900.5; 5/725

[58] Field of Search ..... 5/655, 632, 630, 5/461, 468, 425, 900.5, 424

[56] References Cited

U.S. PATENT DOCUMENTS

| | | | |
|---|---|---|---|
| D. 259,458 | 6/1981 | Fuller et al. | 5/900.5 |
| D. 317,994 | 7/1991 | Collins | D6/605 |
| 1,432,875 | 10/1922 | Lavagetto | 5/425 |
| 3,339,216 | 9/1967 | Ormerod | 5/461 |
| 3,885,258 | 5/1975 | Regan | 5/400.5 |
| 4,073,020 | 2/1978 | Stalter et al. | 5/481 |
| 4,471,767 | 9/1984 | Guimond | 5/425 |
| 4,566,449 | 1/1986 | Smith | 5/655 |
| 4,631,766 | 12/1986 | Semmler et al. | 5/655 |
| 4,790,041 | 12/1988 | Shtull | 5/655 |
| 4,885,918 | 2/1989 | Vacearo | 5/611 |
| 4,972,535 | 11/1990 | Goldman | 5/481 |
| 5,029,351 | 7/1991 | Weber | 5/655 |
| 5,189,748 | 3/1993 | Garrison et al. | 5/655 |
| 5,216,772 | 6/1993 | Clute | 5/655 |
| 5,272,780 | 12/1993 | Clute | 5/655 |
| 5,367,730 | 11/1994 | Sher | 5/655 |

*Primary Examiner*—Alexander Grosz

[57] ABSTRACT

A mattress for supporting an infant in a supine position during sleep. The inventive device includes a main cushion member having a central portion top wall tapering into an inclined head wall whereat a head of the infant can be positioned. A pair of lateral guides extend along opposed longitudinal sides of the central portion top wall for engaging lateral portions of the infant to preclude turning of the infant into a prone position. Breathing apertures are directed through both the inclined head wall of the main cushion member and the lateral guides to preclude blocking of the infants breathing during sleep, thereby reducing the incidence of infant sleeping death.

8 Claims, 2 Drawing Sheets

SUPPORTIVE MATTRESS

BACKGROUND OF THE INVENTION

1. Field of the Invention

The present invention relates to mattress structures and more particularly pertains to a supportive mattress for supporting an infant in a supine position during sleep.

2. Description of the Prior Art

The use of mattress structures is known in the prior art. More specifically, mattress structures heretofore devised and utilized are known to consist basically of familiar, expected and obvious structural configurations, notwithstanding the myriad of designs encompassed by the crowded prior art which have been developed for the fulfillment of countless objectives and requirements.

Known prior art mattress structures include U.S. Pat. Nos. 4,073,020; 4,885,918; 4,972,535; 3,885,258; and U.S. Pat. No. Des. 317,994.

While these devices fulfill their respective, particular objectives and requirements, the aforementioned patents do not disclose a mattress for supporting an infant in a supine position during sleep which includes a main cushion member having a central portion top wall tapering into an inclined head wall, and a pair of lateral guides extending along opposed longitudinal sides of the central portion top wall for engaging lateral portions of the infant to preclude turning of the infant into a prone position. Furthermore, none of the known prior art mattress structures listed above include breathing apertures are directed through both the inclined head wall of the main cushion member and the lateral guides to preclude blocking of the infants breathing during sleep.

In these respects, the supportive mattress according to the present invention substantially departs from the conventional concepts and designs of the prior art, and in so doing provides an apparatus primarily developed for the purpose of supporting an infant in a supine position during sleep.

SUMMARY OF THE INVENTION

In view of the foregoing disadvantages inherent in the known types of mattress structures now present in the prior art, the present invention provides a new supportive mattress construction wherein the same can be utilized for supporting an infant in a supine position during sleep. As such, the general purpose of the present invention, which will be described subsequently in greater detail, is to provide a new supportive mattress apparatus and method which has many of the advantages of the mattress structures mentioned heretofore and many novel features that result in a supportive mattress which is not anticipated, rendered obvious, suggested, or even implied by any of the prior art mattress structures, either alone or in any combination thereof.

To attain this, the present invention generally comprises a mattress for supporting an infant in a supine position during sleep. The inventive device includes a main cushion member having a central portion top wall tapering into an inclined head wall whereat a head of the infant can be positioned. A pair of lateral guides extend along opposed longitudinal sides of the central portion top wall for engaging lateral portions of the infant to preclude turning of the infant into a prone position. Breathing apertures are directed through both the inclined head wall of the main cushion member and the lateral guides to preclude blocking of the infants breathing during sleep, thereby reducing the incidence of infant sleeping death.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new supportive mattress apparatus and method which has many of the advantages of the mattress structures mentioned heretofore and many novel features that result in a supportive mattress which is not anticipated, rendered obvious, suggested, or even implied by any of the prior art mattress structures, either alone or in any combination thereof.

It is another object of the present invention to provide a new supportive mattress which may be easily and efficiently manufactured and marketed.

It is a further object of the present invention to provide a new supportive mattress which is of a durable and reliable construction.

An even further object of the present invention is to provide a new supportive mattress which is susceptible of a low cost of manufacture with regard to both materials and labor, and which accordingly is then susceptible of low prices of sale to the consuming public, thereby making such supportive mattresses economically available to the buying public.

Still yet another object of the present invention is to provide a new supportive mattress which provides in the apparatuses and methods of the prior art some of the advantages thereof, while simultaneously overcoming some of the disadvantages normally associated therewith.

Still another object of the present invention is to provide a new supportive mattress for supporting an infant in a supine position during sleep.

Yet another object of the present invention is to provide a new supportive mattress which includes a main cushion member having a central portion top wall tapering into an inclined head wall, and a pair of lateral guides extending along opposed longitudinal sides of the central portion top wall for engaging lateral portions of the infant to preclude turning of the infant into a prone position.

Even still another object of the present invention is to provide a new supportive mattress in which breathing apertures are directed through both the inclined head wall of the main cushion member and the lateral guides to preclude blocking of the infants breathing during sleep.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
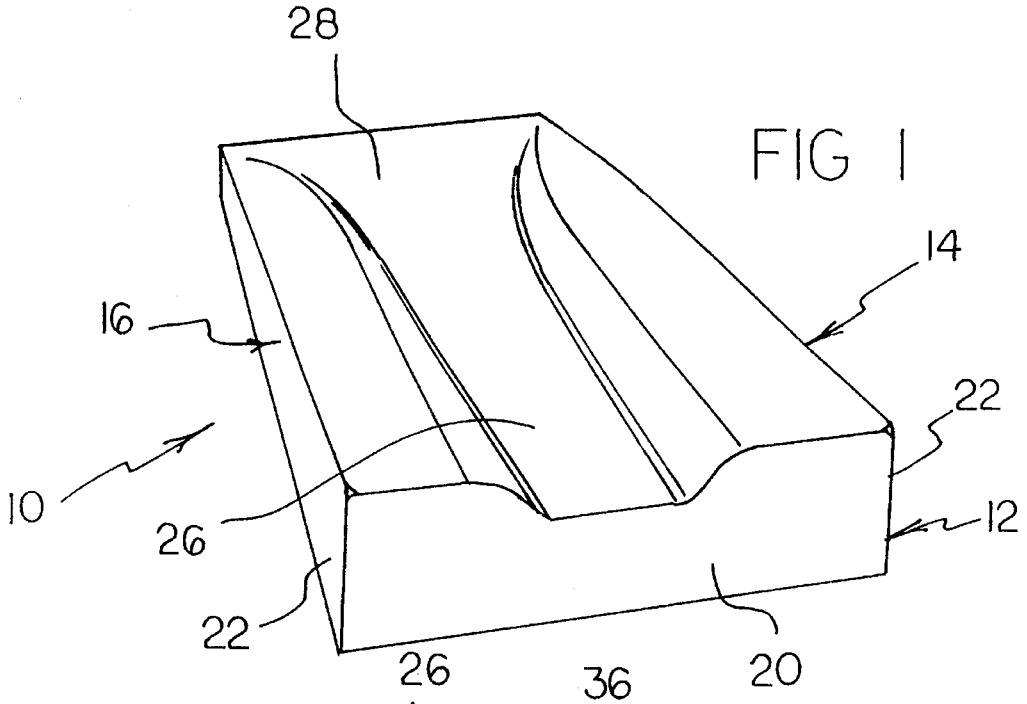
FIG. 1 is an isometric illustration of a supportive mattress according to the present invention.

With reference now to the drawings, and in particular to FIGS. 1–4 thereof, a new supportive mattress embodying the principles and concepts of the present invention and generally designated by the reference numeral 10 will be described.

More specifically, it will be noted that the supportive mattress 10 comprises a substantially rectangular main cushion member 12 positionable atop or within an unillustrated supporting surface, such as an infant crib or the like. A pair of lateral guide means 14, 16 extend along opposed sides of the main cushion member 12 and cooperate to engage opposed sides of an infant placed on top of the main cushion member to preclude turning of the infant into a prone position during sleep, as shown in FIG. 1.

Figure 2:
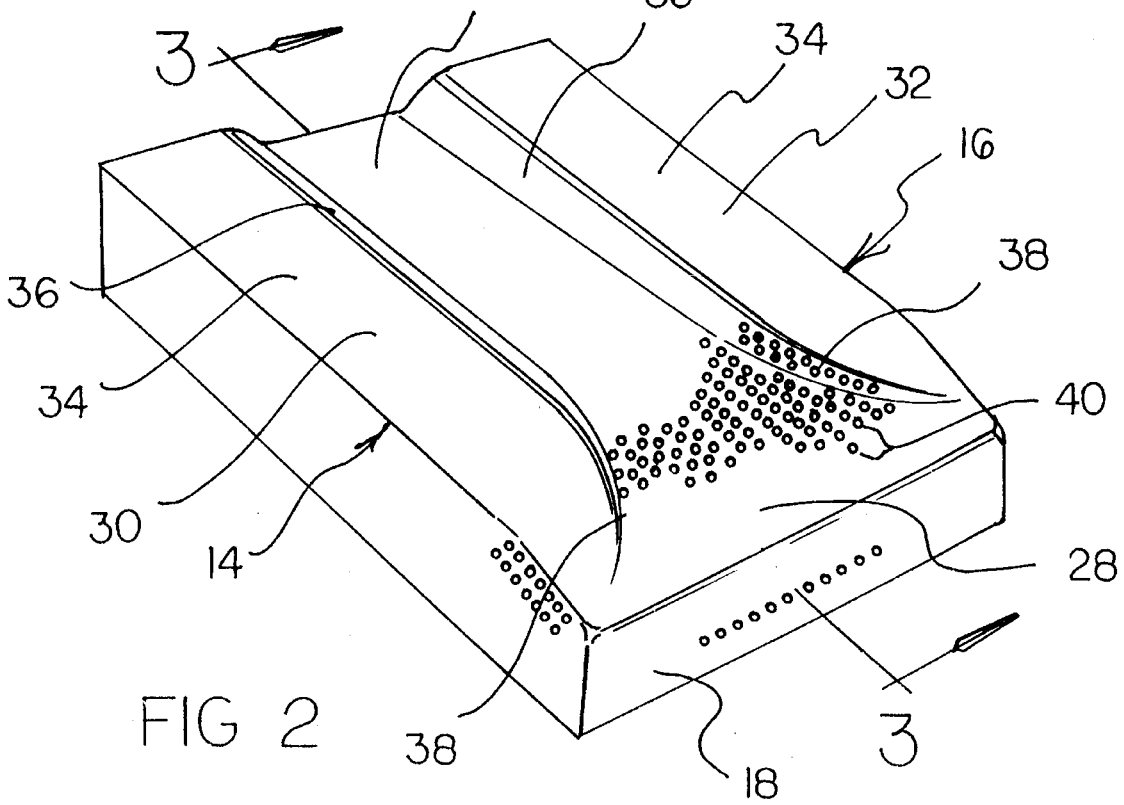
FIG. 2 is a further isometric illustration of the invention.
Figure 3:
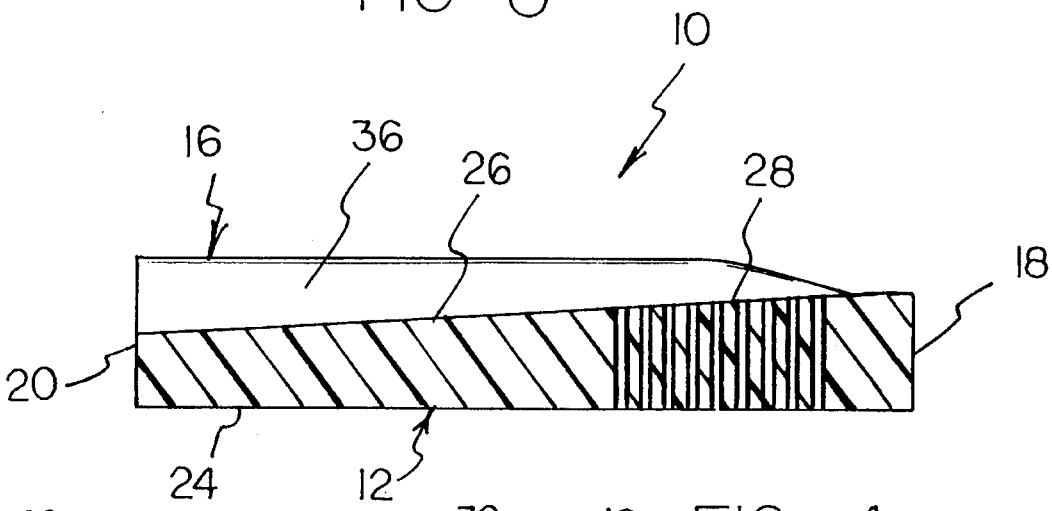
FIG. 3 is a cross sectional view taken along line 3—3 of FIG. 2.
Figure 4:
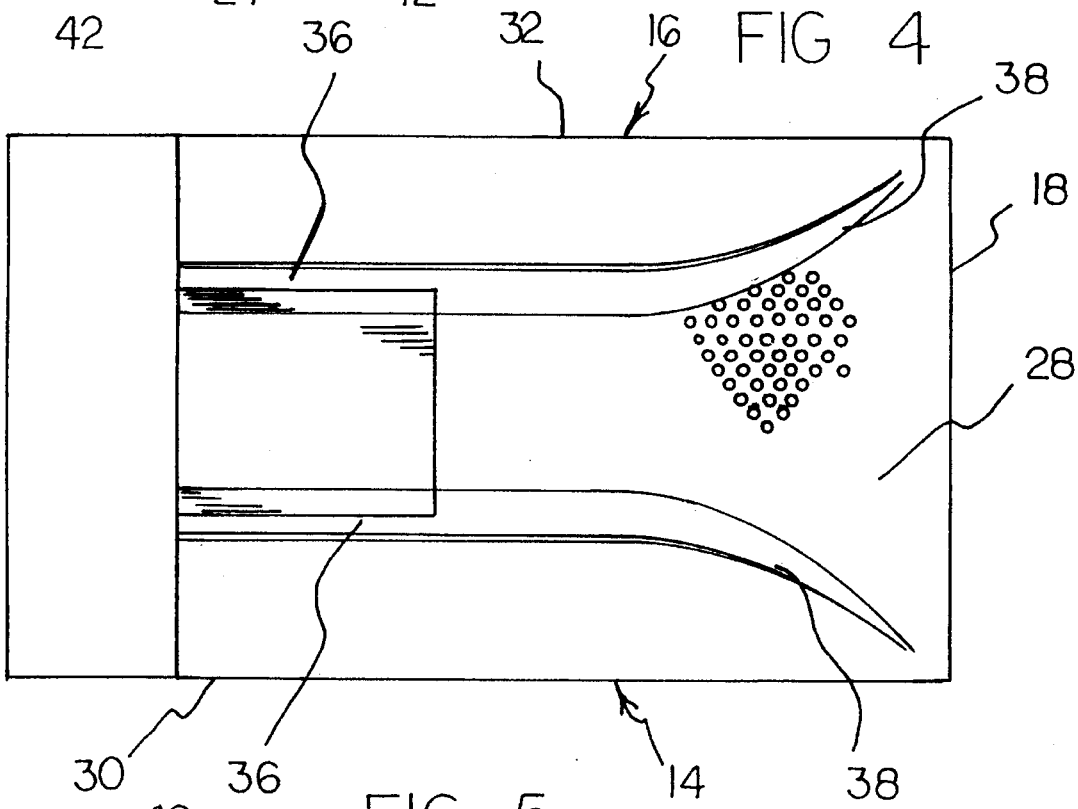
FIG. 4 is a top plan view of the invention.
Figure 5:
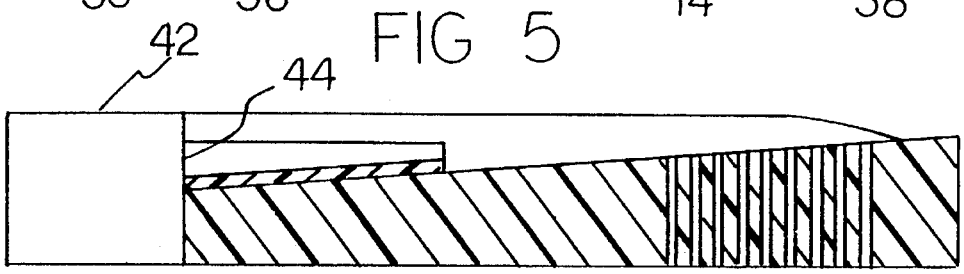
FIG. 5 is a cross-sectional view of the invention illustrated in FIG. 4.

As best illustrated FIGS. 2 through 4 it can be shown that the main cushion member 12 includes a front wall 18 spaced from a rear wall 20, with opposed side walls 22 extending between the front and rear walls. The walls 18 22 are of substantially planar configuration to define the substantially rectangular shape of the main cushion member. The main cushion member 12 further includes a bottom wall 24 of substantially flat configuration positionable atop the supporting surface, and a central portion top wall 26 extending at an oblique angle relative to the bottom wall. The central portion top wall 26 extends from the rear wall 20 and continues into an inclined head wall 28 extending into intersection with the front wall 18. The inclined head wall 28 extends upwardly from the central portion top wall 26 and is oriented at an oblique angle relative to the bottom wall 24. Thus, a front wall height dimension of the main cushion member 12 at the front wall 18 is substantially greater than a rear wall height dimension at the rear wall 20 to define the inclined head wall 28 extending between the front wall and the central portion top wall 26. By this structure, an infant placed upon the mattress in a supine position will rest thereon with the infant's head positioned at a slightly inclined angle relative to the horizontal.

As shown in the figures, the lateral guide means 14 and 16 according to the present invention 10 extend along opposed sides of the center portion top wall and cooperate to engage sides of the infant placed within the invention to preclude turning of the infant into a prone position. To this end, the lateral guide means comprise lateral cushion members 30 and 32 which are preferably integrally formed with the main cushion member 12 so as to extend along opposed sides of the center portion top wall 26 thereof. The lateral cushion members 30 and 32 each include a lateral cushion member top wall 34 of substantially planar configuration and oriented so as to extend in a substantially parallel and spaced orientation relative to the bottom wall 24 and the central portion top wall 26 of the main cushion member 12. The lateral cushion members 30 and 32 each include an angled side wall 36 connecting the respective lateral cushion member top walls to the central portion top wall 26. Preferably, the angled side walls 36 of the lateral cushion members 30 and 32 extend at an oblique angle relative to the central portion top wall 26 of approximately forty five degrees. The angled sidewalls 36 of the lateral cushion members 30 and 32 extend into contiguous communication with the rear wall 20 of the main cushion member 12 and continue along the main cushion member and along the inclined head wall 28 to define tapered arcuate sidewalls 38 which flare from a center of the inclined head wall towards the side walls 22 of the main cushion member. Preferably, the lateral cushion members 30 and 32 are of a first transverse dimension extending transversely across the lateral cushion member top walls thereof along a portion of the longitudinal length thereof to the intersection of the central portion top wall 26 and the inclined head wall 28 whereat the tapered arcuate sidewalls begin. The lateral cushion members 30 and 32 then arcuately taper along a portion of the longitudinal length thereof from the intersection of the central portion top wall 26 and the inclined head wall 28 to terminate proximal to the front wall of the main cushion member 12. The lateral cushion members thus taper to a second transverse dimension extending transversely across the lateral cushion member top walls thereof, wherein the first transverse dimension is substantially greater than the second transverse dimension to define the arcuate shape of the tapered arcuate side walls 38. By this structure, the infant's head is permitted to laterally articulate within a plane parallel to the inclined head wall 28, while the infant's body is precluded from rotating from a supine position to a prone position which could result in a placement of the infant's breathing passageways, i.e. the nose and/or mouth of the infant, into sealing contact with the mattress 10. Thus, an infant placed within the device 10 is restrained from assuming a position which could result in possible asphyxiation of the infant.

As shown in FIGS. 2 through 4, the present invention may additionally include breathing apertures 40 directed through both the main cushion member 12 and the lateral guide means 14 and 16. To this end, the breathing apertures 40 preferably comprises a first set of breathing apertures directed vertically through the main cushion member 12 and extending from the inclined head wall 28 thereof through to the bottom wall 24. The breathing apertures 40 additionally include horizontally extending apertures continuing into contiguous communication with the first set of breathing apertures which permit an infant to breath through the breathing apertures when the bottom wall 24 of the mattress 10 is placed into sealing contact with a support surface. As shown in FIG. 4, the breathing apertures 40 further include a second set of breathing apertures directed through the lateral cushion members 30 and 32 and extending from the tapered arcuate side walls thereof through to the sidewalls 22 of the main cushion member 12. The second set of breathing apertures 40 similarly operate to permit an infant to breathe through the mattress 10. By this structure, an infant of sufficient age or strength to assume a prone sleeping position of the mattress will still retain the ability to breathe through the apertures 40. Further, the breathing apertures 40 permit a drainage of bodily fluids, i.e. vomit or saliva, through the mattress 10 to preclude drowning of the infant.

In use, the supportive mattress 10 according to the present invention can be easily placed within a crib or the like. An infant positioned within the mattress will then be discouraged from rolling from a supine position into a prone position which could result in asphyxiation of the infant. Further, any potentially dangerous fluids which could result in drowning of the infant will be safely drained away through the breathing apertures 40 from the facial area and breathing passages of the infant.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A supportive mattress comprising:

a main cushion member which include a front wall spaced from a rear wall, with opposed side walls extending between the front and rear walls, the walls being of substantially planar configuration to define a substantially rectangular shape of the main cushion member, wherein the main cushion member further includes a bottom wall of substantially flat configuration, a central portion top wall extending substantially parallel to the bottom wall, the central portion top wall extending from the rear wall and continuing into an inclined head wall extending into intersection with the front wall, the inclined head wall extending upwardly from the central portion top wall and being oriented at an oblique angle relative to the bottom wall, wherein a front wall height dimension of the main cushion member at the front wall is substantially greater than a rear wall height dimension at the rear wall and, lateral guide means extending along the main cushion member for engaging opposed sides of an infant placed on top of the main cushion member to preclude turning of the infant, wherein lateral guide means comprise lateral cushion members coupled to the central portion top wall and the inclined head wall of the main cushion member so as to extend along opposed sides of the center portion top wall, wherein the lateral cushion members each include a lateral cushion member top wall of substantially planar configuration and oriented so as to extend in a substantially parallel and spaced orientation relative to the bottom wall, the lateral cushion members each further include an angled side wall connecting the lateral cushion member top wall to the central portion top wall, the angled sidewalls of the lateral cushion members extending into contiguous communication with the rear wall of the main cushion member and continuing along the main cushion member and along the inclined head wall to define tapered arcuate sidewalls which flare from a center of the inclined head wall towards the side walls of the main cushion member, wherein the lateral cushion members are of a first transverse dimension extending transversely across the lateral cushion member top walls thereof along a portion of the longitudinal length thereof to the intersection of the central portion top wall and the inclined head wall whereat the tapered arcuate sidewalls begin, the lateral cushion members arcuately tapering along a portion of the longitudinal length thereof from the intersection of the central portion top wall and the inclined head wall to terminate proximal to the front wall of the main cushion member whereat the lateral cushion members are of a second transverse dimension extending transversely across the lateral cushion member top walls thereof, wherein the first transverse dimension is substantially greater than the second transverse dimension to define the arcuate shape of the tapered arcuate side walls.

2. The supportive mattress of claim 1, wherein the main cushion member is shaped so as to define a first set of breathing apertures directed vertically through the main cushion member and extending from the inclined head wall thereof through to the bottom wall.

3. The supportive mattress of claim 2, wherein the main cushion member is further shaped so as to define horizontally extending apertures extending from the front wall thereof and continuing into contiguous communication with the first set of breathing apertures.

4. The supportive mattress of claim 3, wherein the main cushion member is still further shaped so as to define a second set of breathing apertures directed through the lateral cushion members and extending from the tapered arcuate side walls thereof through to the sidewalls of the main cushion member.

5. A supportive mattress comprising:

a main cushion member including a front wall spaced from a rear wall, with opposed side walls extending between the front and rear walls, the walls being of substantially planar configuration to define a substantially rectangular shape of the main cushion member, the main cushion member further including a bottom wall of substantially flat configuration, a central portion top wall extending substantially parallel to the bottom wall, the central portion top wall extending from the rear wall and continuing into an inclined head wall extending into intersection with the front wall, the inclined head wall extending upwardly from the central portion top wall and being oriented at an oblique angle relative to the bottom wall, wherein a front wall height dimension of the main cushion member at the front wall is substantially greater than a rear wall height dimension at the rear wall, and lateral guide means extending along the main cushion member for engaging opposed sides of an infant placed on top of the main cushion member to preclude turning of the infant, the lateral guide means comprising lateral cushion members coupled to the central portion top wall and the inclined head wall of the main cushion member so as to extend along opposed sides of the center portion top wall, wherein the lateral cushion members each include a lateral cushion member top wall of substantially planar configuration and oriented so as to extend in a substantially parallel and spaced orientation relative to the bottom wall, the lateral cushion members each further include an angled side wall connecting the lateral cushion member top wall to the central portion top wall, the angled sidewalls of the lateral cushion members extending into contiguous communication with the rear wall of the main cushion member and continuing along the main cushion member and along the inclined head wall to define tapered arcuate sidewalls which flare from a center of the inclined head wall towards the side walls of the main cushion member, wherein the lateral cushion members are of a first transverse dimension extending transversely across the lateral cushion member top walls thereof along a portion of the longitudinal length thereof to the intersection of the central portion top wall and the inclined head wall whereat the tapered arcuate sidewalls begin, the lateral cushion members arcuately tapering along a portion of the longitudinal length thereof from the intersection of the central portion top wall and the inclined head wall to terminate proximal to the front wall of the main cushion member whereat the lateral cushion members are of a second transverse dimension extending transversely across the lateral cushion member top walls thereof, wherein the first transverse dimension is substantially greater than the second transverse dimension to define the arcuate shape of the tapered arcuate side walls.

6. The supportive mattress of claim 5, wherein the main cushion member is shaped so as to define a first set of breathing apertures directed vertically through the main cushion member and extending from the inclined head wall thereof through to the bottom wall.

7. The supportive mattress of claim 6, wherein the main cushion member is further shaped so as to define horizontally extending apertures extending from the front wall thereof and continuing into contiguous communication with the first set of breathing aperture.

8. The supportive mattress of claim 7, wherein the main cushion member is still further shaped so as to define a second set of breathing apertures directed through the lateral cushion members and extending from the tapered arcuate side walls thereof through to the sidewalls of the main cushion member.

* * * * *